US008303080B2

(12) United States Patent
Yoshida et al.

(10) Patent No.: US 8,303,080 B2
(45) Date of Patent: Nov. 6, 2012

(54) INK-JET HEAD AND INK-JET APPARATUS

(75) Inventors: Hidehiro Yoshida, Osaka (JP); Kazuki Fukada, Osaka (JP)

(73) Assignee: Panasonic Corporation, Osaka (JP)

( * ) Notice: Subject to any disclaimer, the term of this patent is extended or adjusted under 35 U.S.C. 154(b) by 78 days.

(21) Appl. No.: 13/079,222

(22) Filed: Apr. 4, 2011

(65) Prior Publication Data

US 2011/0242226 A1 Oct. 6, 2011

(30) Foreign Application Priority Data

Apr. 5, 2010 (JP) ..... 2010-087081
Feb. 21, 2011 (JP) ..... 2011-034505

(51) Int. Cl.
*B41J 2/045* (2006.01)

(52) U.S. Cl. ..... 347/38; 347/72

(58) Field of Classification Search ..... None
See application file for complete search history.

(56) References Cited

U.S. PATENT DOCUMENTS

| | | | | |
|---|---|---|---|---|
| 2005/0093931 | A1 | 5/2005 | Kodama | |
| 2006/0092237 | A1* | 5/2006 | Kwon et al. | 347/68 |
| 2008/0079759 | A1 | 4/2008 | Nagashima | |
| 2009/0174735 | A1 | 7/2009 | Yamada | |
| 2011/0310181 | A1* | 12/2011 | Curcio et al. | 347/54 |

FOREIGN PATENT DOCUMENTS

| | | | |
|---|---|---|---|
| JP | 2000-177121 | A | 6/2000 |
| JP | 2005-119287 | A | 5/2005 |
| JP | 2008-087288 | A | 4/2008 |
| JP | 2008-200902 | A | 9/2008 |
| JP | 2009-160807 | A | 7/2009 |

* cited by examiner

*Primary Examiner* — Matthew Luu
*Assistant Examiner* — Lisa M Solomon
(74) *Attorney, Agent, or Firm* — Pearne & Gordon LLP

(57) ABSTRACT

An ink-jet head includes an ink chamber; an ink supply channel through which ink to be supplied to the ink chamber flows; an ink discharge channel through which the ink discharged from the ink chamber flows; a partition wall constituting a side surface of the ink chamber; an ink inlet opening formed in the partition wall, the ink inlet opening communicating with the ink supply channel; an ink outlet opening formed in the partition wall, the ink outlet opening communicating with the ink discharge channel; a piezo-mounting plate constituting a top surface of the ink chamber; an expandable multilayer piezoelectric element placed inside the ink chamber, the multilayer piezoelectric element having a fixed end secured to the piezo-mounting plate and a movable end directing to the expanding direction of the multilayer piezoelectric element; a nozzle plate constituting a bottom surface of the ink chamber; and a nozzle formed in the nozzle plate, the nozzle communicating with the ink chamber, wherein the multilayer piezoelectric element is separated from the partition wall, and the ink inlet opening is positioned closer to the fixed end of the multilayer piezoelectric element than to the movable end thereof.

6 Claims, 19 Drawing Sheets

INK-JET HEAD AND INK-JET APPARATUS

CROSS REFERENCE TO RELATED APPLICATIONS

This application is entitled and claims the benefit of Japanese Patent Application No. 2010-087081, filed on Apr. 5, 2010, and Japanese Patent Application No. 2011-034505, filed on Feb. 21, 2011, the disclosure of each of which including the specification, drawings and abstract is incorporated herein by reference in its entirety.

TECHNICAL FIELD

This disclosure relates to an ink-jet head and an ink-jet apparatus having the same.

BACKGROUND ART

The drop-on-demand ink-jet head is known as an ink-jet head that can eject, in response to the input signal, required amounts of ink droplets only when they are needed to print on the medium. In particular, extensive research is being undertaken on the piezoelectric (piezo) drop-on-demand ink-jet head as it is capable of well-controlled discharge of a wide variety of inks. The piezo drop-on-demand ink-jet head generally includes an ink supply channel; a plurality of ink chambers with a nozzle, which are connected to the ink supply channel; and piezoelectric elements for applying a pressure to the ink filling the ink chambers.

In such a piezo drop-on-demand ink-jet head, piezoelectric elements deform by application of a drive voltage, whereby a pressure is applied to the ink in ink chambers, causing ink droplets to be discharged from nozzles. Broadly, there are three types of piezo drop-on-demand ink-jet head according to the manner in which the piezoelectric element deforms: shear mode, push mode, and bend mode. In particular, because of its ability to produce high power at low voltage, the bend-mode piezo ink-jet head that uses multilayer piezoelectric elements is expected to be further developed for use in the manufacturing of electric devices using highly viscous ink, such as manufacturing of organic EL display panels and liquid crystal panels.

Ink-jet heads sometimes encounter the problem of failing to accurately discharge ink droplets due to air inclusion or nozzle clogging. To overcome this drawback, there have been proposed techniques in which ink is allowed to circulate through the ink-jet head, i.e., fed into and discharged from ink chambers such that air inclusion and nozzle clogging are reduced (see, e.g., Patent Literatures 2 to 6).

Also proposed are ink-circulating ink-jet heads in which piezoelectric elements are placed inside respective ink chambers (see, e.g., Patent Literatures 7 and 8).

FIG. 1 is a sectional view of an ink-circulating ink-jet head disclosed by Patent Literatures 7 and 8. As illustrated in FIG. 1, ink-jet head 1 of Patent Literatures 7 and 8 includes ink chambers 10, ink supply channel 11 in which the ink to be supplied to ink chambers 10 flows, and ink discharge channel 12 in which the ink discharged from ink chamber 10 flows.

Ink chamber 10 is composed of nozzle plate 20 which constitutes a bottom surface of ink chamber 10 and has nozzle 21; piezo-mounting plate 30 which constitutes a top surface of ink chamber 10 and to which piezoelectric element 31 is secured; and partition wall 40 which constitutes a side surface of ink chamber 10.

Ink inlet opening 33 for supplying ink to ink chamber 10 from ink supply channel 11 and ink outlet opening 35 for discharging ink from ink chamber 10 to ink discharge channel 12 are formed in piezo-mounting plate 30.

Ink flows from supply channel 11 into ink discharge channel 12 through ink chamber 10. Thus, new ink is continuously supplied to ink chamber 10. Continuously supplying new ink to ink chamber 10 avoids possible ink discharge failure caused by ink stagnation or air inclusion inside ink chamber 10.

Application of a drive voltage to piezoelectric element 31 in ink-jet head 1 having such a structure causes piezoelectric element 31 to expand, resulting in the application of a force to the ink inside ink chamber 10 in discharge direction. A portion of ink that has received the force is then discharged from nozzle 21.

Although the ink-circulating ink-jet head can avoid ink stagnation or air inclusion inside ink chambers, it has been said that further enhancement of ink discharge power is impossible with this type of ink-jet head due to the presence of two force-releasing routes (ink inlet opening 33 and ink outlet opening 25) from which the force generated by driving the piezoelectric element is released.

CITATION LIST

Patent Literature

PTL 1: Japanese Patent Application Laid-Open No. 2000-177121

PTL 2: Japanese Patent Application Laid-Open No. 2008-200902

PTL 3: Japanese Patent Application Laid-Open No. 2005-119287

PTL 4: U.S. Patent Application Publication No. 2005/0093931

PTL 5: Japanese Patent Application Laid-Open No. 2008-087288

PTL 6: U.S. Patent Application Publication No. 2008/0079759

PTL 7: Japanese Patent Application Laid-Open No. 2009-160807

PTL 8: U.S. Patent Application Publication No. 2009/0174735

SUMMARY OF INVENTION

Technical Problem

However, even with an ink-circulating ink-jet head in which ink is allowed to flow through ink chambers, ink stagnation sometimes occurs.

FIG. 2 is a sectional view of ink-circulating ink-jet head 2, a different ink-circulating ink-jet head from that illustrated in FIG. 1. Ink-jet head 2 illustrated in FIG. 2 includes ink chamber 10, ink supply channel 11, and ink discharge channel 12. Ink chamber 10 is composed of nozzle plate 20 in which nozzle 21 is formed, piezo-mounting plate 30 in which multilayer piezoelectric element 31 is secured, and partition wall 40 which constitutes a side surface of ink chamber 10. In partition wall 40, ink inlet opening 33 for supplying ink to ink chamber 10 from ink supply channel 11, and ink outlet opening 35 for discharging ink from ink chamber 10 to ink discharge channel 12, are formed. In ink-jet head 2, multilayer piezoelectric element 31 is separated from partition wall 40. Thus, a gap is formed between multilayer piezoelectric element 31 and partition wall 40.

When ink is supplied to ink chamber 10 as illustrated in FIG. 2, the ink flowed into the gap between multilayer piezoelectric element 31 and partition wall 40 is difficult to move. For this reason, there is concern that the ink flowed into the gap between multilayer piezoelectric element 31 and partition wall 40 stagnates therein. Ink stagnation in ink chambers adversely affects ink discharge performance, causing such problems as instable ink discharge.

As a measure to avoid possible ink stagnation between multilayer piezoelectric element 31 and partition wall 40, the ink inlet opening may be formed in piezo-mounting plate 30 rather than in the partition wall, as disclosed by Patent Literature 2. By forming an ink inlet opening in piezo-mounting plate 30 as in ink-jet head 1 of Patent Literature 2 illustrated in FIG. 1, the ink supplied from the ink inlet opening flows between piezoelectric element 31 and partition wall 40; therefore, ink stagnation does not take place therein.

However, when an ink inlet opening is formed in piezo-mounting plate 30, some of the force generated by driving the piezoelectric element is released through the ink inlet opening, thus resulting in the reduction of ink discharge power (see FIG. 6A).

An object of the present invention is therefore to provide an ink-circulating ink-jet head capable of preventing ink stagnation in ink chambers while ensuring high ink discharge power.

Solution to Problem

The inventors established that prevention of ink stagnation in ink chambers and high ink discharge power can be achieved at the same time by appropriately adjusting the positions of the ink inlet opening and multilayer piezoelectric element. With additional studies, the inventors completed the present invention.

A first aspect of the present invention thus relates to ink-jet heads given below.

[1] An ink-jet head including:

an ink chamber;

an ink supply channel configured to allow ink to flow, the ink being supplied to the ink chamber;

an ink discharge channel configured to allow ink to flow, the ink being discharged from the ink chamber;

a partition wall constituting a side surface of the ink chamber;

an ink inlet opening formed in the partition wall, the ink inlet opening communicating with the ink supply channel;

an ink outlet opening formed in the partition wall, the ink outlet opening communicating with the ink discharge channel;

a piezo-mounting plate constituting a top surface of the ink chamber;

an expandable multilayer piezoelectric element placed inside the ink chamber, the multilayer piezoelectric element having a fixed end secured to the piezo-mounting plate and a movable end directing to an expanding direction of the multilayer piezoelectric element;

a nozzle plate constituting a bottom surface of the ink chamber; and a nozzle formed in the nozzle plate, the nozzle communicating with the ink chamber, wherein the multilayer piezoelectric element is separated from the partition wall, and the ink inlet opening is positioned closer to the fixed end of the multilayer piezoelectric element than to the movable end thereof.

[2] The ink-jet head according to [1], further including an ink inlet channel for linking the ink inlet opening and the ink supply channel together, wherein the ink inlet channel has a bend.

[3] The ink-jet head according to [1] or [2], further including an ink outlet channel for linking the ink outlet opening and the ink discharge channel together, wherein the ink outlet channel has a bend.

A second aspect of the present invention relates to an ink-jet apparatus given below.

[4] An ink-jet apparatus including the ink-jet head according to any one of [1] to [3].

Advantageous Effects of Invention

The ink-jet head of present invention is free from ink stagnation in ink chambers, and offers high ink discharge power. Thus, the ink-jet head of the present invention can stably apply highly viscous ink.

DESCRIPTION OF EMBODIMENTS

1. Ink-Jet Head

Figure 1:
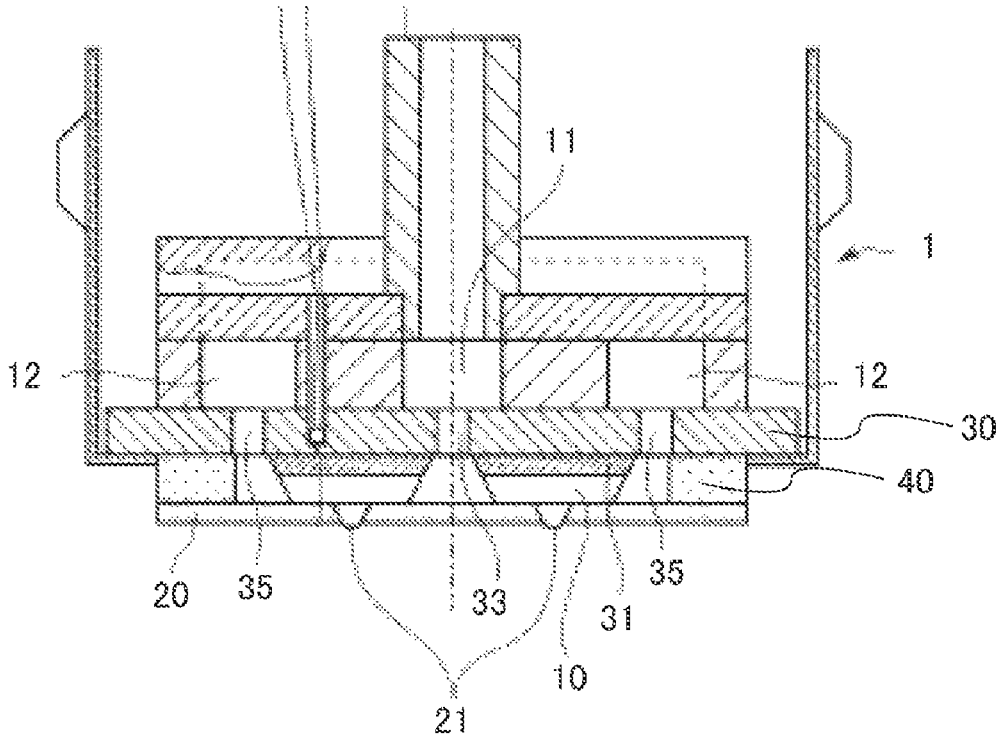
FIG. 1 is a sectional view illustrating an example of the conventional ink-jet head.
Figure 2:
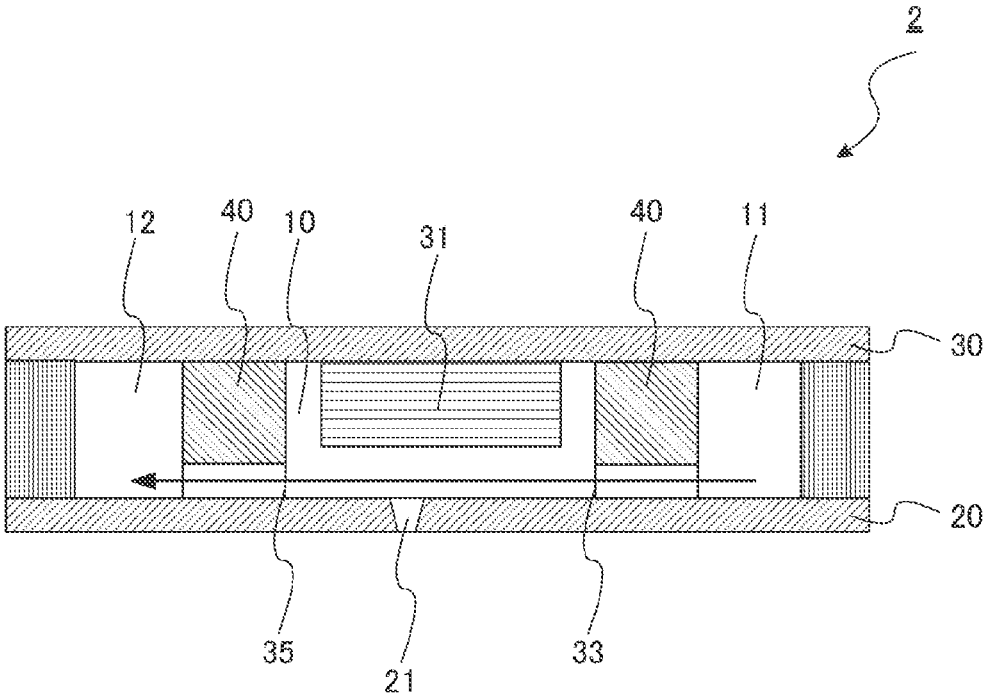
FIG. 2 is a sectional view illustrating another example of the conventional ink-jet head.

An ink-jet head of the present invention is a bend-mode ink-jet head comprising multilayer piezoelectric elements. The present invention is also directed to an ink-circulating ink-jet head in which ink flows through ink chambers.

An ink-jet head of the present invention includes 1) an ink supply channel, 2) an ink discharge channel, and 3) ink chambers. Each component will be described below.

1) Ink Supply Channel

The ink supply channel is a passage configured to allow ink to flow. The ink is supplied to the ink chamber. The ink supply channel includes a feed port through which ink is supplied from outside. A plurality of ink chambers is connected to the ink supply channel along the ink flow direction. There are no particular limitations on the flow rate of ink to be supplied to the ink supply channel; ink flow rate may be equal to or greater than several ml/min.

2) Ink Discharge Channel

The ink discharge channel is a passage configured to allow ink discharged from ink chambers to flow. The ink discharge channel includes a discharge port for discharging ink to the outside. The ink chambers are connected to the ink discharge channel along the ink flow direction.

3) Ink Chamber

The ink chamber is a space to be supplied with ink which will be discharged through a nozzle (later described). The ink chamber is connected to the ink supply channel and ink discharge channel. Thus, ink flows from the ink supply channel into the ink discharge channel through ink chambers. In this way new ink is continuously supplied to the ink chamber. By continuously supplying new ink to ink chamber, it is possible to avoid ink discharge failure caused by ink stagnation or air inclusion inside the ink chamber. Ink flow rate in the ink chamber is preferably 10 to 100 ml/min.

Generally, up to 1024 ink chambers are connected to a single ink supply channel and a single ink discharge channel. There are no particular limitations on the type of ink to be supplied into the ink chamber; ink type depends on the type of the product to be manufactured. For example, when using the ink-jet head for the manufacturing of an organic EL display panel, examples of inks to be supplied to the ink chamber include solutions of luminescent material such as organic luminescent substance. In the case of a liquid crystal display panel, examples of inks include highly viscous functional solutions such as liquid crystal material solutions.

Next, constituent members of an ink chamber will be described. In the present invention, an ink chamber is composed of a nozzle plate, a partition wall, and a piezo-mounting plate. That is to say, the ink-jet head of the present invention further includes 4) a nozzle plate, 5) a partition wall, and 6) a piezo-mounting plate.

4) Nozzle Plate

The nozzle plate constitutes a bottom surface of an ink chamber. The nozzle plate is a 10-100 μm thick stainless steel (e.g., SUS 304 stainless steel) plate.

The ink-jet head of the present invention includes a nozzle formed in the nozzle plate. The nozzle is a passage having a discharge opening for discharging ink from an ink chamber. The ink-jet head may have one or more nozzles per ink chamber. The ink inside the ink chamber flows through the nozzle and is discharged to the outside through the discharge opening. There are no particular limitations on the discharge opening diameter; for example, discharge opening diameter of 10 to 100 μm will suffice.

5) Partition Wall

The partition wall is a plate constituting a side surface of an ink chamber. The partition wall may be prepared by, for example, bonding together a plurality of stainless steel (e.g., SUS 304 stainless steel) plates by thermal diffusion bonding. The partition wall may be of rectangular or tapered shape in cross section. It suffices that the partition wall is 5 to 100 μm higher than the multilayer piezoelectric element, and is generally 105 to 1,100 μm in height. The partition wall is bonded to the piezo-mounting plate and nozzle plate. Bonding may be accomplished by using an adhesive or by welding, or by thermal diffusion bonding (heat-pressing).

The ink-jet head of the present invention further includes an ink inlet opening and an ink outlet opening, which are formed in the partition wall.

The ink inlet opening communicates with the ink supply channel. Thus, ink flows from the ink supply channel into the ink chamber through the ink inlet opening. The ink inlet opening and the ink supply channel are generally linked via an ink inlet channel. The ink inlet channel may be linear, but preferably has a bend (see Embodiment 2, FIG. 7).

The ink outlet opening communicates with the ink discharge channel. Thus, ink flows from the ink chamber into the ink discharge channel through the ink outlet opening. The ink outlet opening and the ink discharge channel are generally linked via an ink outlet channel. The ink outlet channel may be linear, but preferably has a bend (see Embodiment 2, FIG. 7).

6) Piezo-Mounting Plate

The piezo-mounting plate constitutes a top surface of an ink chamber. As used herein, the term "top surface of an ink chamber" refers to an internal surface of an ink chamber opposing a nozzle plate. The material of the piezo-mounting plate is ceramics, for example. By employing ceramics as piezo-mounting plate material, the thermal expansion coefficient of a piezoelectric element (later described) can be made equal to that of the piezo-mounting plate.

The ink-jet head of the present invention further includes a piezoelectric element secured to the piezo-mounting plate.

The piezoelectric element is an actuator for converting a control signal into actual motion. By applying a drive voltage to the piezoelectric element, it expands and thereby applies a pressure to the ink that resides in the ink chamber. This causes an ink droplet to be discharged from the nozzle.

The piezoelectric element employed in the present invention is an expandable multilayer piezoelectric element (hereinafter may simply referred to as a "multilayer piezoelectric element"). Multilayer piezoelectric elements respond slowly to input, but produce large output force. The height of the multilayer piezoelectric element (length in which piezoelectric elements are stacked) is generally 100 to 1,000 μm.

The multilayer piezoelectric element has a fixed end to be secured to a piezo-mounting plate (later described), and a movable end directing to the expanding direction of the multilayer piezoelectric element.

In the present invention, the multilayer piezoelectric element and partition wall are separated from each other. Thus, a gap is formed between the multilayer piezoelectric element and partition wall. The gap is preferably 5 to 100 μm in width, more preferably 5 to 20 μm in width. If the gap width is less than 5 μm, there is concern that the multilayer piezoelectric element contacts the partition wall when it expands upon application of voltage. On the other hand, if the gap width is greater than 20 μm, some of the force generated by the application of pressure runs away into the gap, which may result in failure to apply sufficient pressure to the ink.

As described above, multilayer piezoelectric elements produce large output, but intensely vibrate at the same time. Thus, there is concern that vibration of multilayer piezoelectric elements is conducted to adjacent ink chambers through partition walls. This phenomenon in which vibration of a piezoelectric element in one ink chamber influences other ink chambers is called "crosstalk." Crosstalk results in variations in ink droplet volumes or ink discharge pitch among ink chambers.

In the ink-jet head of the present invention, by contrast, the conduction of vibration of multilayer piezoelectric elements to adjacent ink chambers does not take place because the multilayer piezoelectric element is separated from partition wall, whereby crosstalk among ink chambers can be suppressed.

With the present invention, prevention of ink stagnation in ink chambers and high ink discharge power can be achieved at the same time by appropriately adjusting the positions of the ink inlet opening relative to the multilayer piezoelectric element. More specifically, prevention of ink stagnation and high ink discharge power are achieved at the same time by: providing an ink inlet opening at a position closer to the fixed end of the multilayer piezoelectric element than to the movable end thereof and, as described above, forming the ink inlet opening in the partition wall.

As used herein, the expression "an ink inlet opening is provided at a position closer to the fixed end of a multilayer piezoelectric element than to the movable end thereof" means that the distance between the ink inlet opening and the piezo-mounting plate is smaller than the distance between the fixed end and movable end (height) of a multilayer piezoelectric element in the non-driven state. The distance between the ink inlet opening and piezo-mounting plate is preferably 100 μm or less, and more preferably 0 (see FIG. 4B). If the distance is greater than 100 μm, it may result in ink stagnation between the multilayer piezoelectric element and the partition wall. The distance between the movable end of the multilayer piezoelectric element and the ink inlet opening as measured along the expanding direction of the multilayer piezoelectric element (hereinafter may simply referred to as a "distance between the movable end of the multilayer piezoelectric element and the ink inlet opening") is preferably 100 μm or more, and more preferably 300 μm or more (see FIG. 4B). If the distance between the movable end of the multilayer piezoelectric element and the ink inlet opening is less than 100 μm, it may result in ink stagnation between the multilayer piezoelectric element and partition wall or it may become likely that the force generated by driving the multilayer piezoelectric element is released through the ink inlet opening.

Figure 5A:
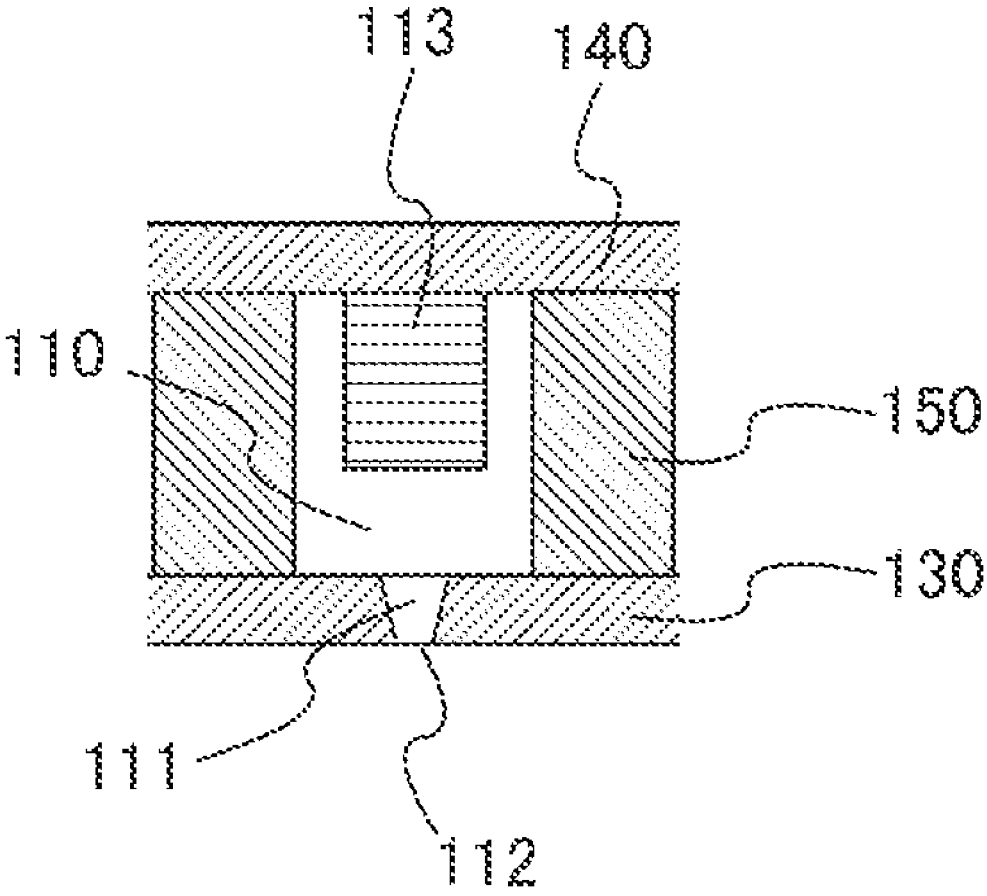
FIG. 5A is an expanded sectional view of an ink chamber illustrated in FIG. 4A.

By providing an ink inlet opening at a position closer to the fixed end of the multilayer piezoelectric element than to the movable end thereof in this way, it is possible to avoid stagnation of ink migrated between the multilayer piezoelectric element and the partition wall (see FIG. 5A).

Furthermore, in the present invention, the ink inlet opening is formed in the partition wall (side surface of an ink chamber), as described above.

Figure 5B:
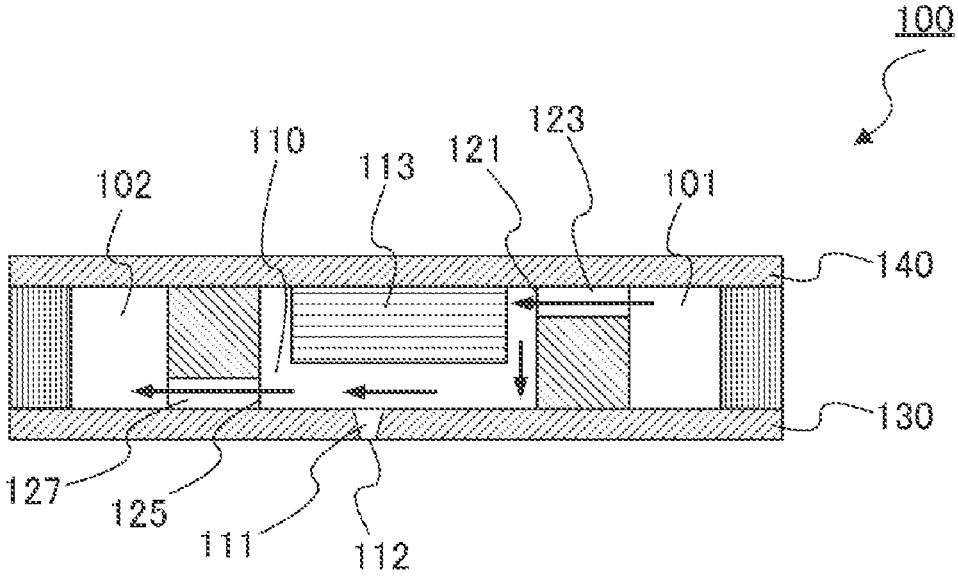
FIG. 5B is an explanatory view of an ink chamber illustrated in FIG. 4B.

By forming an ink inlet opening in the partition wall at a position closer to the fixed end of the multilayer piezoelectric element than to the movable end thereof in this way, it is also possible to prevent the force generated by driving the multilayer piezoelectric element from releasing through the ink inlet opening (see FIG. 5B). Prevention of the force generated by driving the multilayer piezoelectric element from releasing through the ink inlet opening enables to effectively convert the force into an ink discharge force, thus producing high ink discharge power.

With the present invention, it is thus possible to achieve prevention of ink stagnation in ink chambers and high ink discharge power at the same time. Thus, the ink-jet head of the present invention can stably discharge highly viscous ink droplets.

Effects of the present invention will be described in detail in Embodiment 1.

2. Manufacturing Method of Ink-Jet Head

The ink-jet head of the present invention described above is manufactured by any desired method as long as the effects of the present invention are not impaired. A preferable example of a manufacturing method of an ink-jet head of the present invention includes: a first step of providing a piezo-mounting plate; a second step of placing a frame on the piezo-mounting plate; and a third step of placing on the frame a nozzle plate having partition walls bonded thereto.

1) In the first step, a piezo-mounting plate having a plurality of multilayer piezoelectric elements secured thereto is provided. The plurality of multilayer piezoelectric elements may be fabricated by i) alternately laminating sheets of lead zirconate titanate (PZT) and conductive films on a piezo-mounting plate to fabricate a single driving element, and ii) segmenting the driving element. Segmentation may be accomplished using a dicing device equipped with a rotating blade.

2) In the second step, a frame is placed on the piezo-mounting plate.

As used herein, the term "frame" refers to a member constituting a side surface of an ink-jet head (see FIG. 3 and FIGS. 4A to 4C, and Reference sign 160). The frame may be bonded to the piezo-mounting plate using an adhesive or by welding, or may be bonded by thermal diffusion bonding (heat-pressing).

3) In the third step, a nozzle plate having partition walls bonded thereto is placed on the frame. In this way ink chambers are formed, each having a bottom surface, a side surface, and a top surface.

The partition walls are so arranged as to be inserted between adjacent multilayer piezoelectric elements. The partition walls may be bonded to the nozzle plate using an adhesive or by welding, or may be bonded by thermal diffusion bonding (heat-pressing). Similarly, the nozzle plate may be bonded to the frame using an adhesive or by welding, or may be bonded by thermal diffusion bonding (heat-pressing).

3. Ink-Jet Apparatus

An ink-jet apparatus of the present invention includes the above-described ink-jet head and other appropriately-selected ink-jet parts known in the art. For example, an ink-jet apparatus of the present invention includes a member of securing the ink-jet head, a transport stage for transporting a print medium, and so forth.

The ink-jet apparatus includes an ink circulation system. The ink circulation system applies a driving pressure to ink, causing the ink to circulate through the ink-jet head. Application of a driving pressure to ink may be accomplished using a pump, but is preferably accomplished using a regulator, a device configured to apply a pressure by using compressed air. This is because regulators can make the driving pressure constant and thereby the ink circulation speed becomes uniform.

The ink-jet head apparatus may be so configured as to circulate ink through the ink-jet head either continuously or intermittingly during operation.

Hereinafter, with reference to the accompanying drawings, embodiments of the present invention will be described, which however shall not be construed as limiting the scope of the invention thereto.

Embodiment 1

Figure 3:
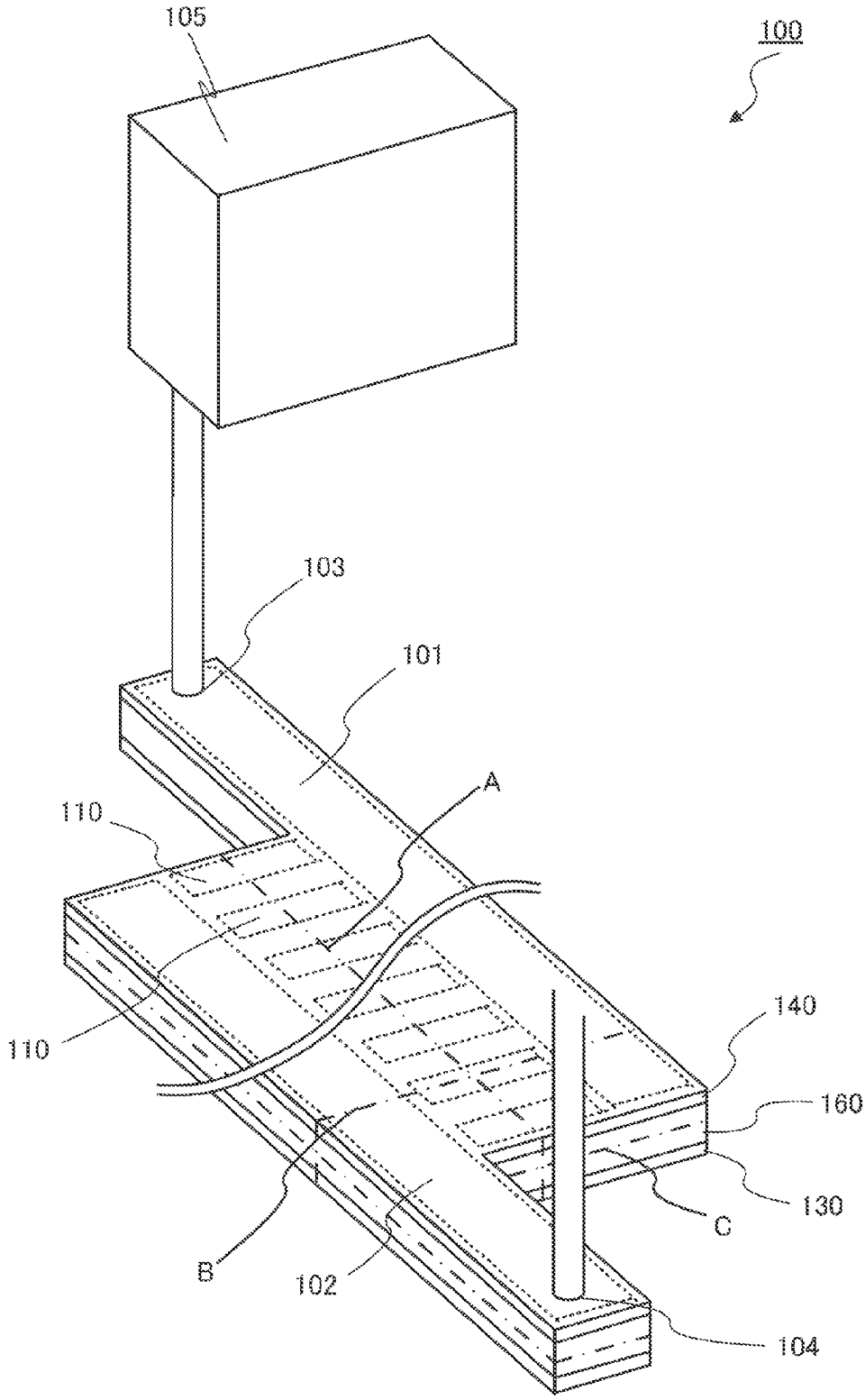
FIG. 3 is a perspective view of an ink-jet head of Embodiment 1.

FIG. 3 is a perspective view of ink-jet head 100 of Embodiment 1 of the present invention. As illustrated in FIG. 3, ink-jet head 100 includes ink supply channel 101, ink discharge channel 102, and ink chambers 110.

Ink supply channel 101 includes ink feed port 103. Ink discharge channel 102 includes ink discharge port 104.

Figure 4A:
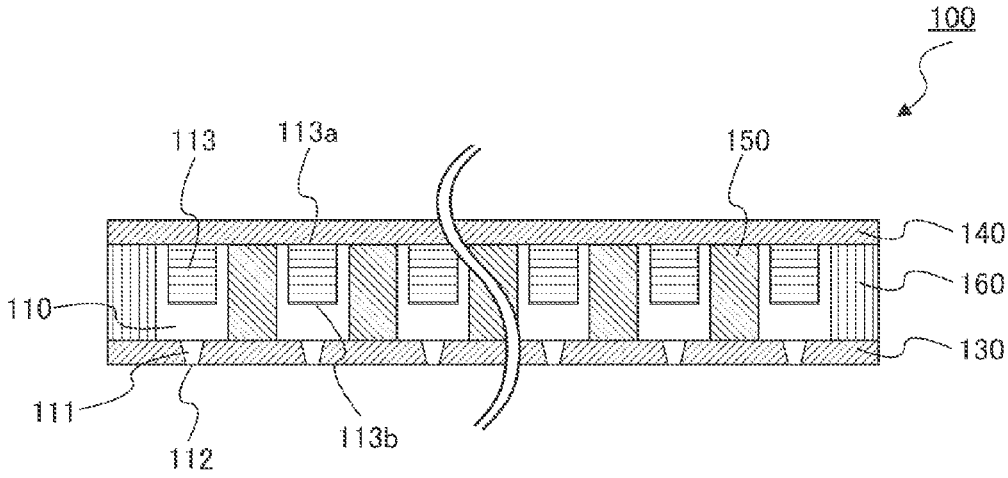
FIG. 4A is a sectional view, taken along line A, of the ink-jet head illustrated in FIG. 3.
Figure 4B:
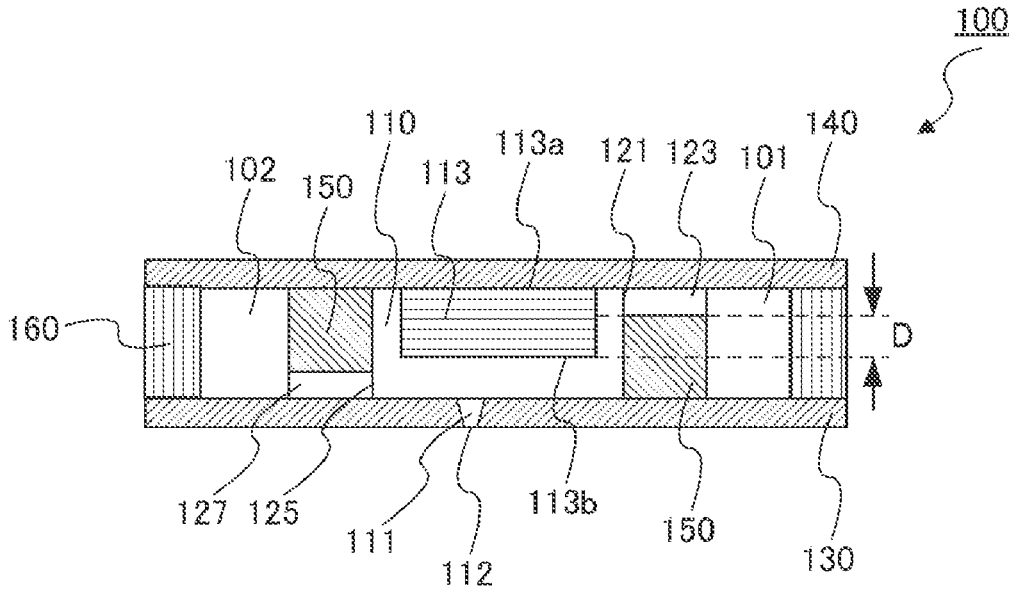
FIG. 4B is a sectional view, taken along line B, of the ink-jet head illustrated in FIG. 3.
Figure 4C:
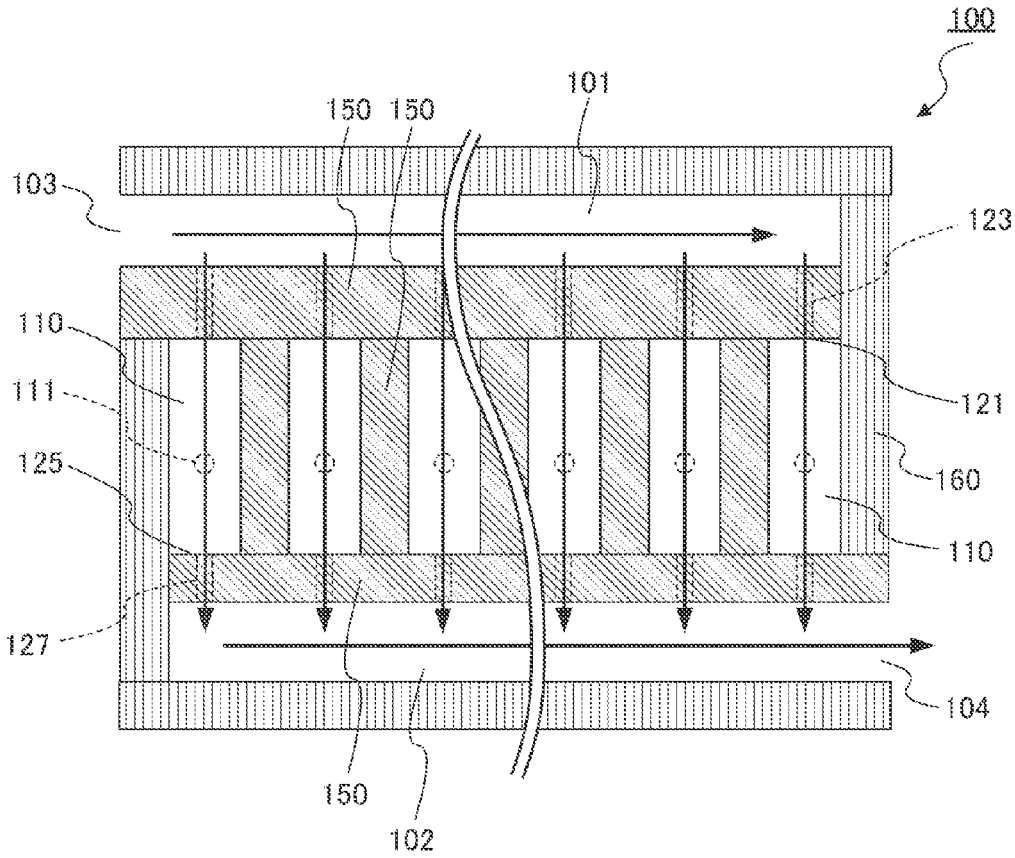
FIG. 4C is a sectional view, taken along line C, of the ink-jet head illustrated in FIG. 3.

FIG. 4A is a sectional view, taken along line A, of ink-jet head 100 illustrated in FIG. 3. FIG. 4B is a sectional view, taken along line B, of ink-jet head 100 illustrated in FIG. 3. FIG. 4C is a sectional view, taken along line C, of ink-jet head 100 illustrated in FIG. 3.

As illustrated in FIGS. 4A to 4C, ink-jet head 100 includes nozzle 111 having discharge opening 112; multilayer piezoelectric element 113; ink inlet opening 121; ink inlet channel 123; ink outlet opening 125; and ink outlet channel 127.

Ink-jet head 100 further includes nozzle plate 130 having nozzle 111 and constituting a bottom surface of ink chamber 110; piezo-mounting plate 140 having multilayer piezoelectric element 113 secured thereto and constituting a top surface of ink chamber 110; and partition wall 150 having ink inlet opening 121 and ink outlet opening 125 and constituting a side surface of ink chamber 110. The side surface of the ink-jet head is also constituted by frame 160.

Ink chamber 110 is connected to ink supply channel 101 via ink inlet opening 121 and ink inlet channel 123. Ink chamber 110 is also connected to ink discharge channel 102 via ink outlet opening 125 and ink outlet channel 127.

In this embodiment, ink inlet channel 123 and ink outlet channel 127 are both made linear, without providing any bend.

As illustrated in FIG. 4A, multilayer piezoelectric element 113 does not contact partition wall 150. The gap between multilayer piezoelectric element 113 and partition wall 150 is 5 to 100 μm. Multilayer piezoelectric element 113 has fixed end 113*a* secured to piezo-mounting plate 140 and movable end 113*b* directing to the expanding direction of multilayer piezoelectric element 113.

As illustrated in FIG. 4B, ink inlet opening 121 and ink outlet opening 125 are formed in partition wall 150. Partition wall 150 in which ink inlet opening 121 is formed and partition wall 150 in which ink outlet opening 125 is formed are facing to each other.

Ink inlet opening 121 is positioned closer to fixed end 113*a* of multilayer piezoelectric element 113 than to movable end 113*b* thereof. In this embodiment, no distance is provided between ink inlet opening 121 and piezo-mounting plate 140. In FIG. 4B, distance D between movable end 113*b* of multilayer piezoelectric element 113 and ink inlet opening 121, as measured along the direction in which multilayer piezoelectric element 113 expands, is preferably 100 μm or more, and more preferably 300 μm or more. Ink outlet opening 125, on the other hand, is positioned closer to movable end 113*b* of multilayer piezoelectric element 113 than to nozzle plate 130.

Figure 5C:
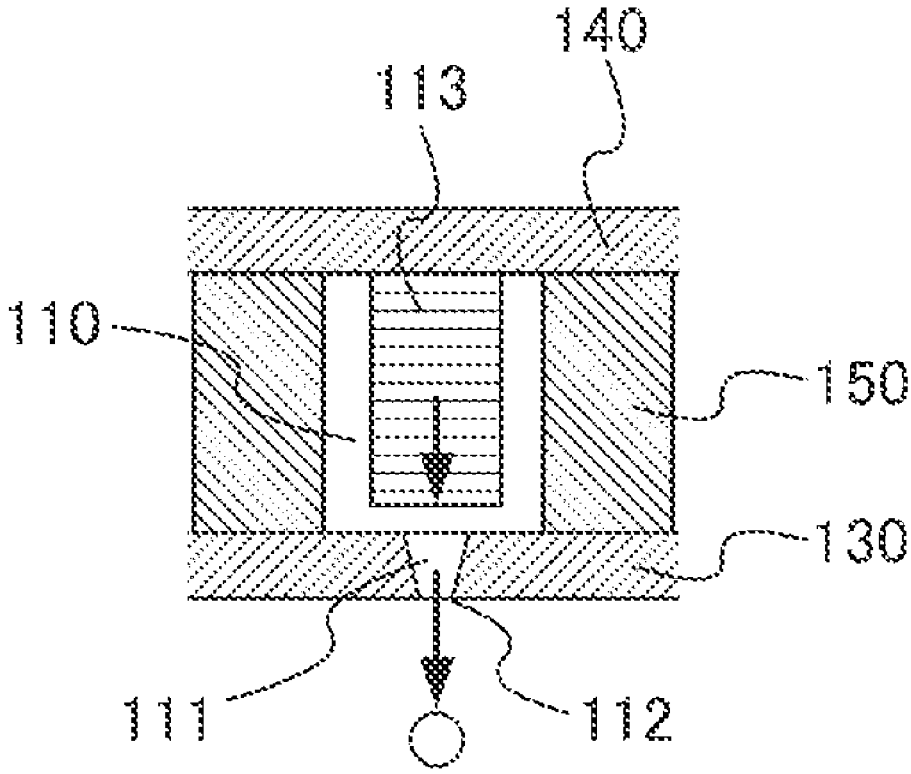
FIG. 5C is an expanded sectional view of an ink chamber illustrated in FIG. 4A.
Figure 5D:
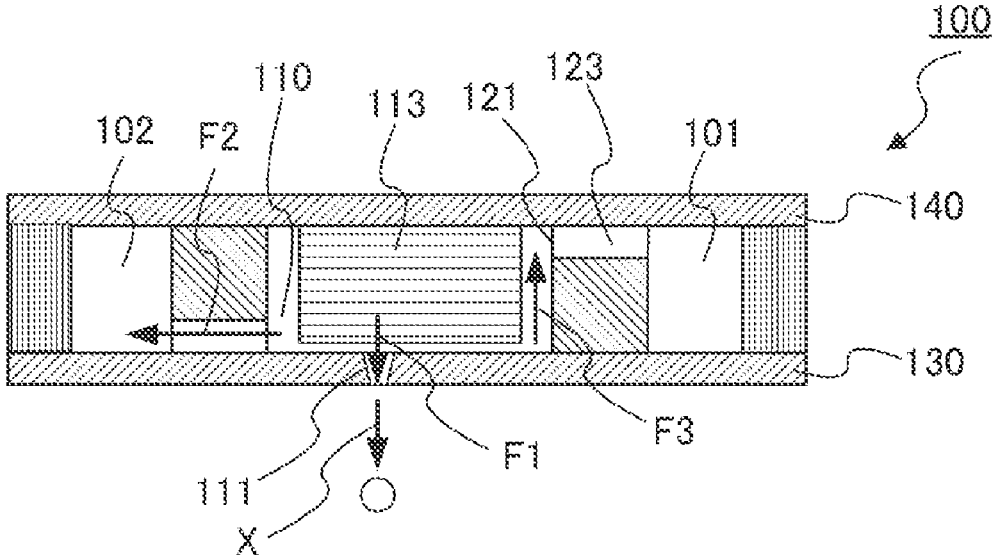
FIG. 5D is an explanatory view of an ink chamber illustrated in FIG. 4B.

Next, operations of ink-jet head 100 of Embodiment 1 will be described with reference to FIGS. 5A to 5D. FIGS. 5A and 5C are expanded sectional views of ink chamber 110 illustrated in FIG. 4A, and FIGS. 5B and 5D are explanatory views of ink chamber 110 illustrated in FIG. 4B.

First, ink is supplied to ink supply channel 101 from ink tank 105. Ink tank 105 preferably has a pressure control mechanism. By providing the ink tank with a pressure control mechanism, it is possible to supply ink from the ink tank to ink supply channel 101 at a constant pressure even when the ink level in the ink tank is lowered as a result of ink consumption. Alternatively, the pressure control mechanism may make the ink supply pressure constant by adjusting the altitude of the ink tank such that the ink level in the ink tank is kept constant.

The ink supplied to ink supply channel 101 then flows through ink inlet channel 123 and ink inlet opening 121 into ink chamber 110 (see FIGS. 5A and 5B). The ink supplied to ink chamber 110 then flows through ink outlet opening 125 and ink outlet channel 127 into ink discharge channel 102. In this way ink flow occurs inside ink chamber 110 and thereby new ink is continuously supplied to ink chamber 110.

Because ink inlet opening 121 is positioned closer to fixed end 113*a* of multilayer piezoelectric element 113 than to movable end 113*b* thereof as mentioned above, ink is also fed between multilayer piezoelectric element 113 and partition wall 150, causing ink flow to take place therein. This avoids ink stagnation between multilayer piezoelectric element 113 and partition wall 150.

On the other hand, if ink inlet opening 33 is positioned closer to nozzle plate 20 than to the movable end of multilayer piezoelectric element 31, there is concern that ink stagnates between multilayer piezoelectric element 31 and partition wall 40 to impede ink flow.

Next, a driving voltage is applied to multilayer piezoelectric element 113, causing multilayer piezoelectric element 113 to expand in height and reducing the volume of ink chamber 110 (see FIGS. 5C and 5D).

As described above, in this embodiment, multilayer piezoelectric element 113 and partition wall 150 are separated from each other. Thus, even when multilayer piezoelectric element 113 has expanded in height as illustrated in FIGS. 5C and 5D, vibration of multilayer piezoelectric element 113 is not conducted to partition wall 150. This reduces crosstalk among ink chambers 110.

Expansion in height of multilayer piezoelectric element 113 results in the generation of force F1 that travels in the same direction as ink discharge direction X. An ink droplet is then discharged from ink chamber 110 by the force generated by driving multilayer piezoelectric element 113.

Some of the force generated by driving multilayer piezoelectric element 113 bounce off nozzle plate 130 and partition wall 150 and are converted to force F2 that travels in a direction perpendicular to ink discharge direction X and force F3 that travels in the opposite direction to ink discharge direction X.

In the ink-jet head of the present invention, ink inlet opening 121 is formed in partition wall 150 at a position closer to fixed end 113*a* of multilayer piezoelectric element 113 than to movable end 113*b* thereof. Specifically, ink inlet opening 121 does not lie on the route in which force F3 travels. With this configuration, force F3 is less likely to be released from ink inlet opening 121. Thus, the force generated by driving multilayer piezoelectric element 113 is effectively converted into an ink discharge force.

Figure 6A:
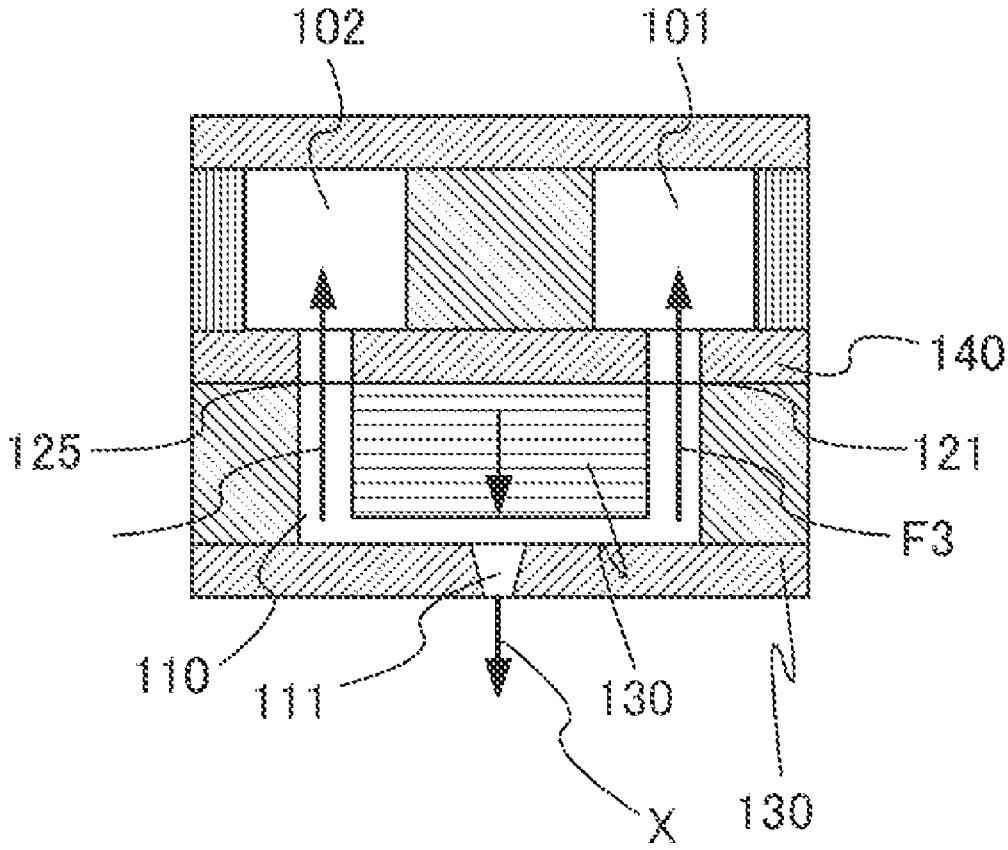
FIG. 6A is a sectional view of an ink-jet head having an ink inlet opening provided in a top surface of an ink chamber.
Figure 6B:
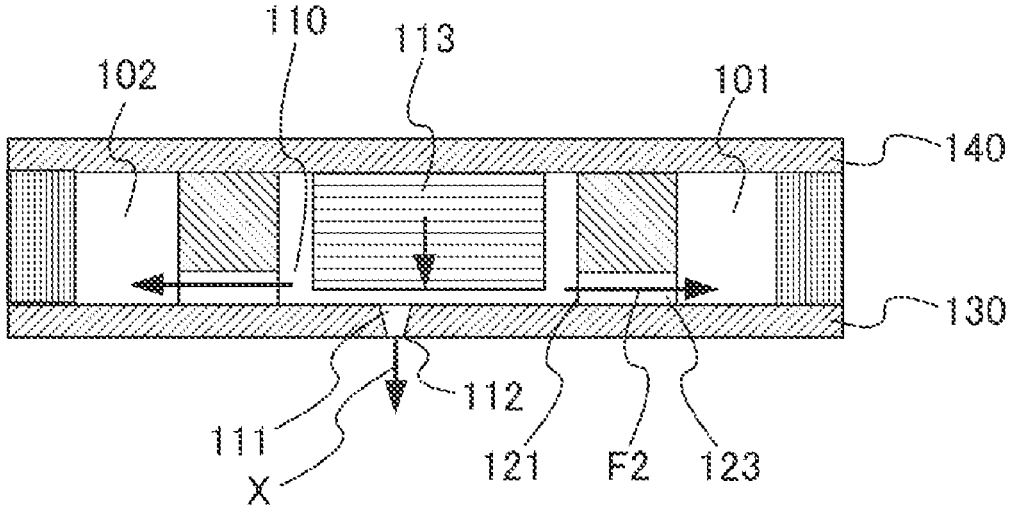
FIG. 6B is a sectional view of an ink-jet head having an ink inlet opening provided in a side surface of an ink chamber on the nozzle plate side.

By contrast, when ink inlet opening 121 is formed in the top surface (piezo-mounting plate 140) rather than in the side surface of an ink chamber as illustrated in FIG. 6A, force F3, travelling in the opposite direction to ink discharge direction X, is more likely to be released from ink inlet opening 121. Thus, the force generated by driving multilayer piezoelectric element 113 is not effectively converted into ink discharge force, resulting in reduced ink discharge power.

Even when ink inlet opening 121 is formed in partition wall 150, providing ink inlet opening 121 at a position closer to movable end 113*b* of multilayer piezoelectric element 113 than to nozzle plate 130 makes force F2, which travels in a direction perpendicular to ink discharge direction X, is more likely released from ink inlet opening 121. Thus, the force generated by driving multilayer piezoelectric element 113 is not effectively converted into an ink discharge force, resulting in reduced ink discharge power.

Alternatively, in order to prevent force F2, which travels in a direction perpendicular to ink discharge direction X, from releasing from ink outlet opening 125, ink outlet opening 125 may be provided at a position closer to piezo-mounting plate 140 than to movable end 113*b* of multilayer piezoelectric element 113. However, this configuration is not preferable because of possible unintended ink leakage from nozzle 111 that occurs when ink is circulated and supplied to ink chamber 110.

Application of an opposite voltage to the driving voltage to multilayer piezoelectric element 113 causes it to decrease in height, thus increasing the volume of ink chamber 110. Inflow of ink into ink chamber 110 from ink supply channel 101 thereby occurs again.

In this way the ink-jet head according to this embodiment can achieve prevention of ink stagnation in ink chambers and high ink discharge power at the same time.

Embodiment 2

Embodiment 1 describes an ink-jet head in which the ink inlet channel and ink outlet channel are linear. Embodiment 2 describes an ink-jet head in which the ink inlet channel and ink outlet channel have a bend.

Figure 7:
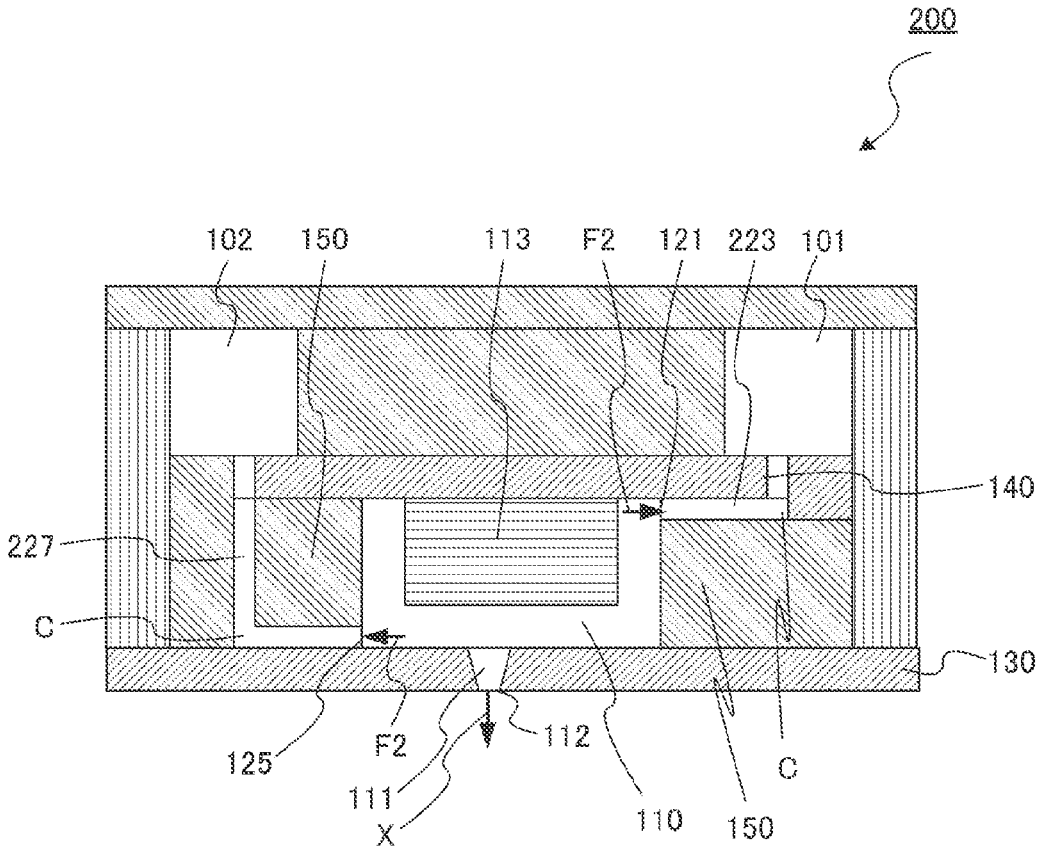
FIG. 7 is a sectional view of an ink-jet head of Embodiment 2.

FIG. 7 is a sectional view of ink-jet head 200 of Embodiment 2. Ink-jet head 200 is identical to ink-jet head 100 of Embodiment 1 illustrated in FIG. 4B except that the ink inlet channel and ink outlet channel have a bend, and the same elements are given to the same reference signs and their description is omitted.

As illustrated in FIG. 7, in ink-jet head 200 of this embodiment, ink inlet channel 223 and ink outlet channel 227 each has bend C. With this configuration, pressure drop in ink inlet channel 223 and ink outlet channel 227 increases. As a result, among forces generated by driving multilayer piezoelectric element 113, force F2 that travels in a direction perpendicular to ink discharge direction X becomes less likely to be released both from ink inlet opening 121 and ink outlet opening 125.

Thus, in this embodiment, ink discharge power can be further enhanced.

Embodiment 3

Embodiment 1 describes an ink-jet head in which the side surface (partition wall) of ink chambers is made perpendicular to the top surface (piezo-mounting plate) and to the bottom surface (nozzle plate). Embodiment 3 describes an ink-jet head in which a taper part is provided on the side surface of ink chambers.

Figure 8:
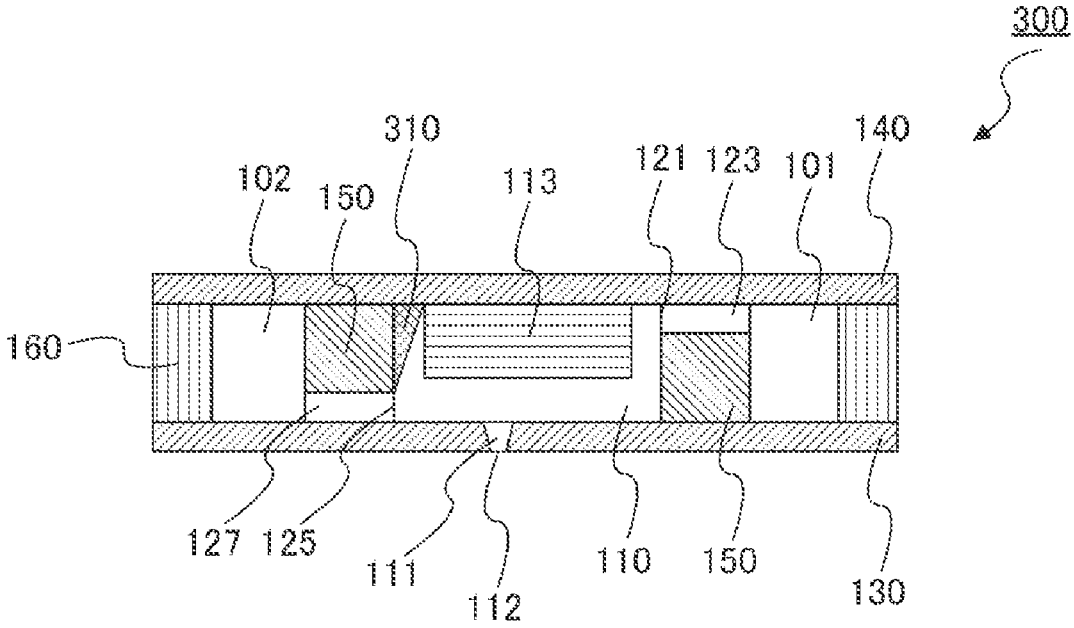
FIG. 8 is a sectional view of an ink-jet head of Embodiment 3.

FIG. 8 is a sectional view of ink-jet head 300 of Embodiment 3. Ink-jet head 300 is identical to ink-jet head 100 of Embodiment 1 illustrated in FIG. 4B except that a taper part is provided on the side surface of the ink chamber, and the same elements are given to the same reference signs and their description is omitted.

As illustrated in FIG. 8, in ink-jet head 300 of this embodiment, taper part 310 is formed on the side surface of ink chamber 110. More specifically, taper part 310 is formed on partition wall 150 opposite to partition wall 150 in which ink inlet opening 121 is formed. With this configuration, ink and air bubbles become less likely to stagnate in the gap between piezoelectric element 130 and partition wall 150. Thus, in this embodiment, ink discharge power can be further enhanced.

Embodiment 4

Embodiment 4 describes an ink-jet head in which a convex part is formed on the side surface of ink chambers.

Figure 9A:
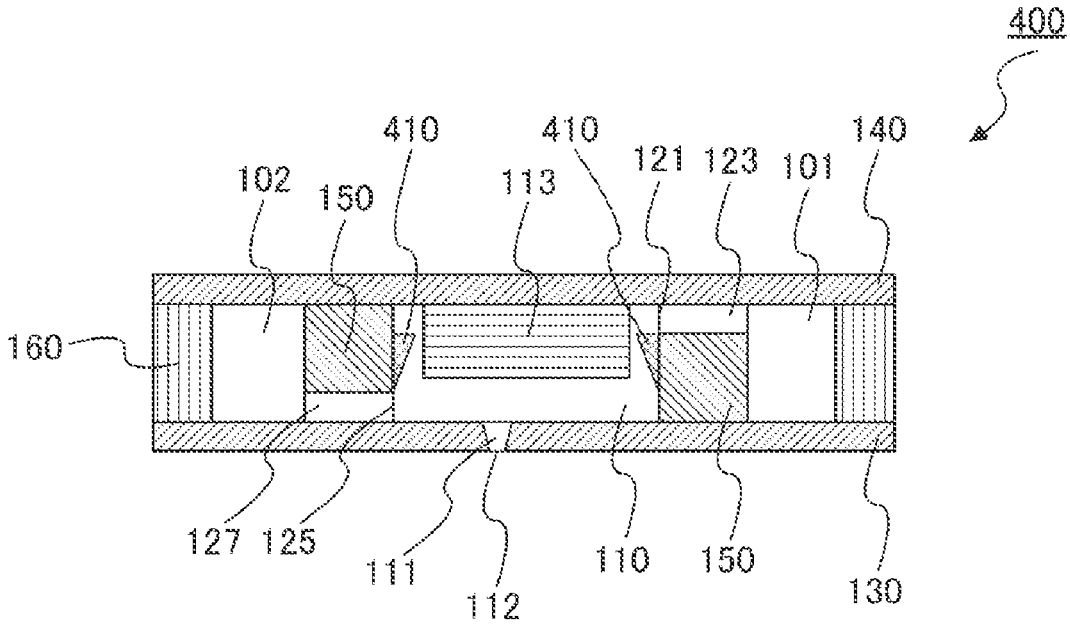
FIG. 9A is a sectional view of an ink-jet head of Embodiment 4.

FIG. 9A is a sectional view of ink-jet head 400 of Embodiment 4.

Figure 9B:
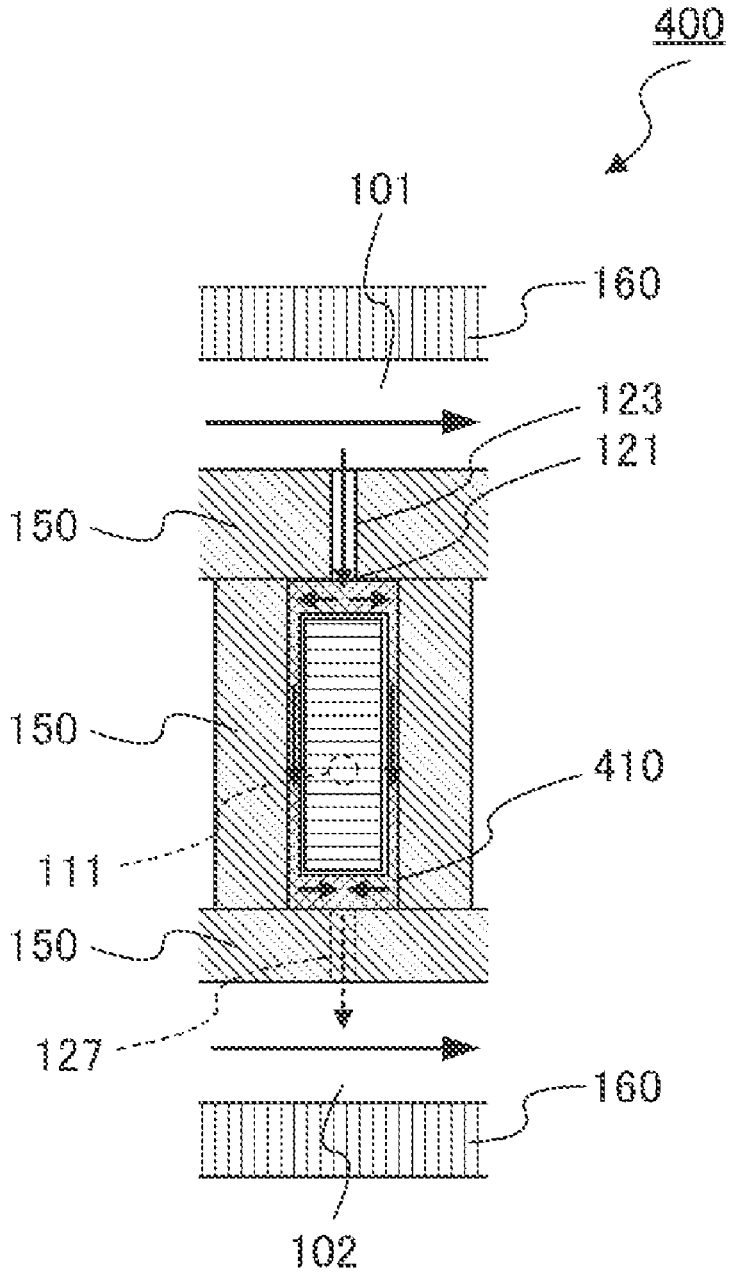
FIG. 9B is a partial enlarged plan view of the ink-jet head illustrated in FIG. 9A.

FIG. 9B is a partial enlarged plan view of ink-jet head 400 of Embodiment, without piezo-mounting plate 140. Ink-jet head 400 is identical to ink-jet head 100 of Embodiment 1 illustrated in FIGS. 4B and 4C except that a convex part is provided on the side surface of ink chambers, and the same elements are given to the same reference signs and their description is omitted.

As illustrated in FIGS. 9A and 9B, in ink-jet head 400 of this embodiment, convex part 410 is formed on the side surface of ink chamber 110. Convex part 410 is formed on partition wall 150 in such a way as to surround multilayer piezoelectric element 113. The ink supplied from ink inlet opening 121 flows through a gap between multilayer piezoelectric element 113 and convex part 410 toward the bottom of ink chamber 110. With this configuration, ink and air bubbles become less likely to stagnate in a particular region of ink chamber 110. Thus, in this embodiment, ink discharge power can be further enhanced.

Embodiment 5

Embodiment 1 describes an ink-jet head in which the ink inlet opening has a smaller width than the ink chamber. Embodiment 5 describes an ink-jet head in which the ink inlet opening has the same width as the ink chamber.

Figure 10A:
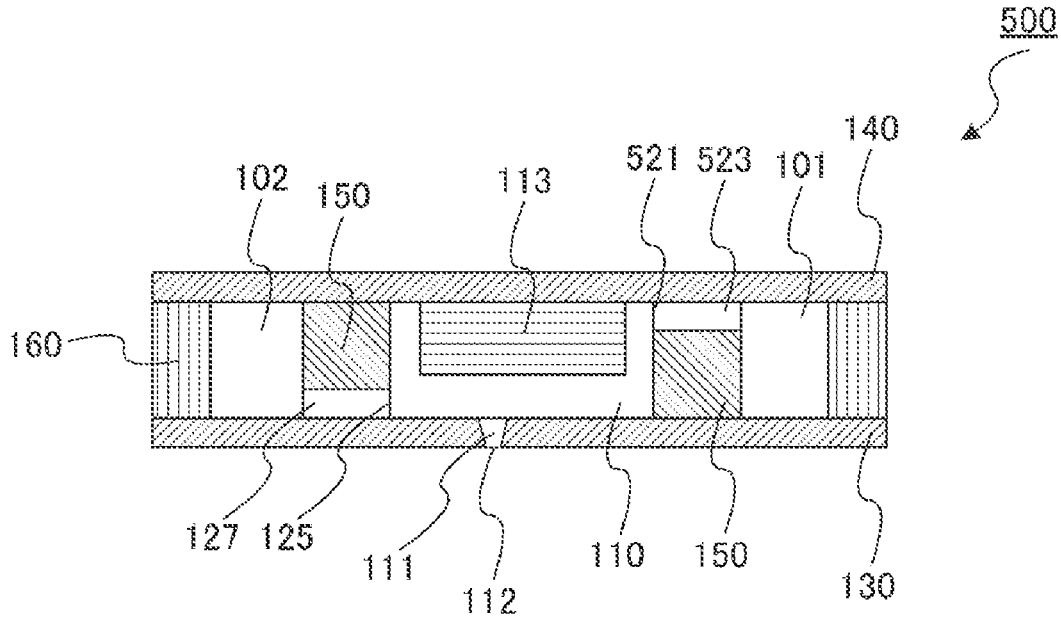
FIG. 10A is a sectional view of an ink-jet head of Embodiment 5.
Figure 10B:
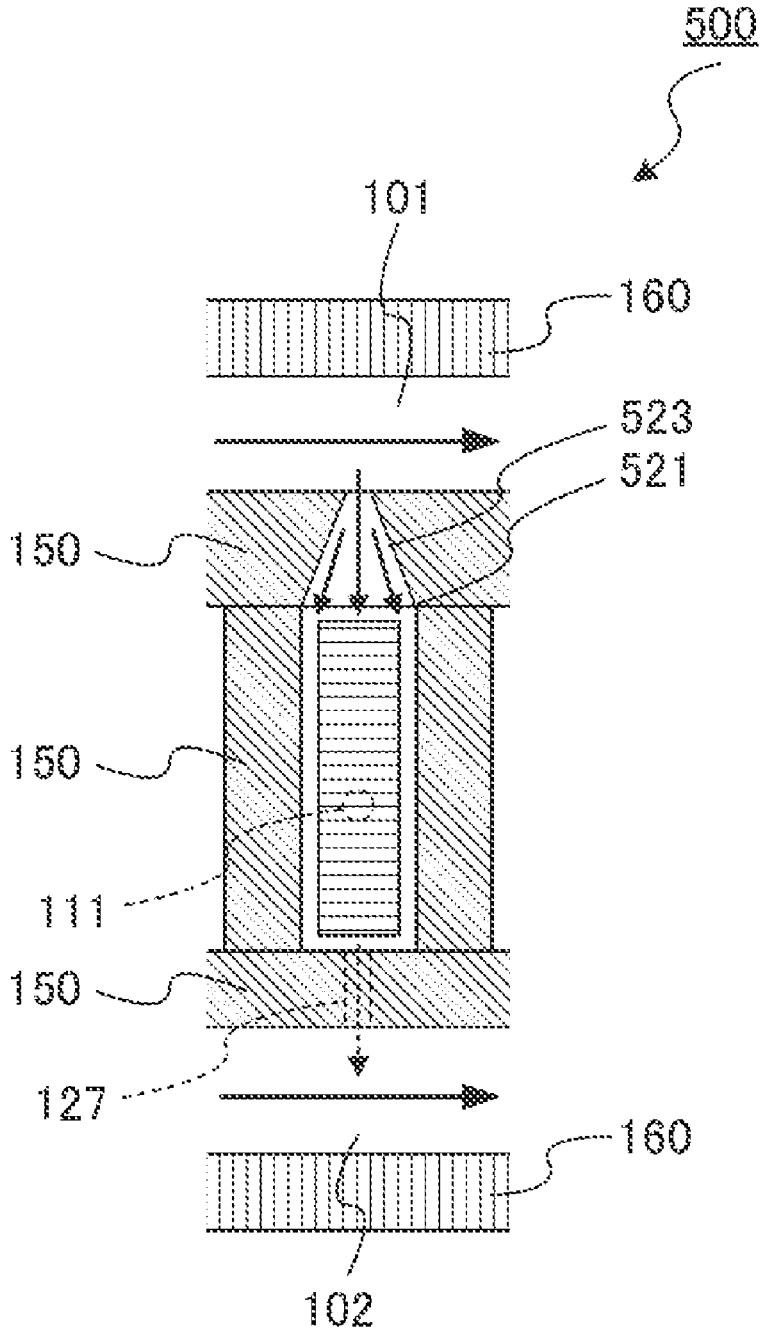
FIG. 10B is a partial enlarged plan view of the ink-jet head illustrated in FIG. 10A.

FIG. 10A is a sectional view of ink-jet head 500 of Embodiment 5. FIG. 10B is a partial enlarged plan view of ink-jet head 500 of Embodiment 5, without piezo-mounting plate 140. Ink-jet head 500 is identical to ink-jet head 100 of Embodiment 1 illustrated in FIGS. 4B and 4C except that ink inlet channel 523 gradually increases in width, and the same elements are given to the same reference signs and their description is omitted.

As illustrated in FIGS. 10A and 10B, in ink-jet head 500 of this embodiment, ink inlet channel 523 gradually increases in width, with ink inlet opening 521 having the same width as ink chamber 110. With this configuration, ink and air bubbles become less likely to stagnate around ink inlet opening 521. Thus, in this embodiment, ink discharge power can be further enhanced.

It should be noted that the entrance of ink inlet channel 523 (joint to ink supply channel 101) is narrower than ink inlet opening 521. This is to avoid unwanted loss of ink discharge pressure.

Embodiment 6

Embodiment 1 describes an ink-jet head in which one ink inlet channel is connected to one ink chamber. Embodiment 6 describes an ink-jet head in which two or more inlet channels are connected to one ink chamber.

Figure 11:
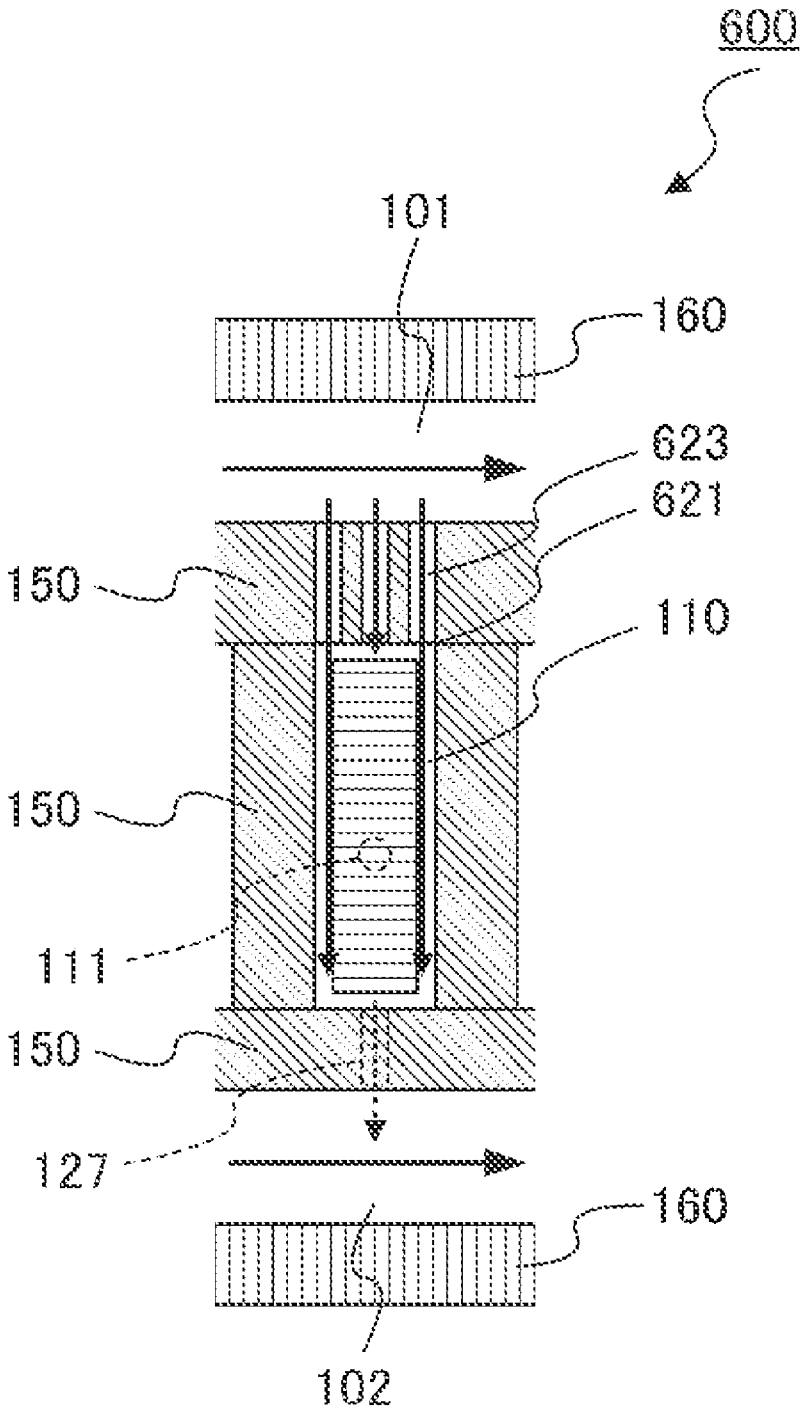
FIG. 11 is a partial enlarged plan view of an ink-jet head of Embodiment 6.

FIG. 11 is a partial enlarged plan view of ink-jet head 600 of Embodiment 6, without piezo-mounting plate 140. Ink-jet head 600 is identical to ink-jet head 100 of Embodiment 1 illustrated in FIG. 4C except that a plurality of ink inlet openings 624 and a plurality of ink inlet channels 623 are provided, and the same elements are given to the same reference signs and their description is omitted.

As illustrated in FIG. 11, in ink-jet head 600 of this embodiment, three ink inlet channels 623 are connected to one ink chamber 110. The two outside ink inlet channels 623 are respectively connected to the corners of ink chamber 110. With this configuration, ink and air bubbles become less likely to stagnate at the corners of ink chamber 110. Thus, in this embodiment, ink discharge power can be further enhanced.

Alternatively, in order to avoid possible stagnation of ink and air bubbles at the corners of ink chamber 110, the width of one of the ink inlet channels 623 may be made equal to the width of ink chamber 110, rather than increasing the number of ink inlet channels 623. However, in view of avoiding possible discharge pressure loss, it is not preferable to make the width of ink inlet channel 623 equal to the width of ink chamber 110.

INDUSTRIAL APPLICABILITY

The ink-jet head of present invention is free from ink stagnation in ink chambers, as well as offers high ink discharge power. Thus, the ink-jet head of the present invention can stably apply highly viscous ink on a medium. Thus, for example, the ink-jet head of the present invention is suitably used as an ink-jet head for applying organic luminescent materials upon manufacturing of organic EL display panels.

REFERENCE SIGNS LIST

100, 200, 300, 400, 500, 600 Ink-jet Head
101 Ink Supply Channel
102 Ink Discharge Channel
103 Ink Feed Port
104 Ink Discharge Port
105 Ink Tank
110 Ink Chamber
111 Nozzle
112 Discharge Opening
113 Multilayer Piezoelectric Element
121, 521, 621 Ink Inlet Opening
123, 223, 523, 623 Ink Inlet Channel
125 Ink Outlet Opening
127 227 Ink Outlet Channel
130 Nozzle Plate
140 Piezo-mounting Plate
150 Partition Wall
160 Frame
310 Taper Part
410 Convex Part

The invention claimed is:

1. An ink-jet head comprising:
an ink chamber;
an ink supply channel configured to allow ink to flow, the ink being supplied to the ink chamber;
an ink discharge channel configured to allow ink to flow, the ink being discharged from the ink chamber;
a partition wall constituting a side surface of the ink chamber;
an ink inlet opening formed in the partition wall, the ink inlet opening communicating with the ink supply channel;
an ink outlet opening formed in the partition wall, the ink outlet opening communicating with the ink discharge channel;
a piezo-mounting plate constituting a top surface of the ink chamber;
an expandable multilayer piezoelectric element placed inside the ink chamber, the multilayer piezoelectric element having a fixed end secured to the piezo-mounting plate and a movable end directing to an expanding direction of the multilayer piezoelectric element;
a nozzle plate constituting a bottom surface of the ink chamber; and
a nozzle formed in the nozzle plate, the nozzle communicating with the ink chamber, wherein
the multilayer piezoelectric element is separated from the partition wall, and
the ink inlet opening is positioned closer to the fixed end of the multilayer piezoelectric element than to the movable end thereof.

2. The ink-jet head according to claim 1, further comprising an ink inlet channel linking the ink inlet opening and the ink supply channel together, wherein the ink inlet channel has a bend.

3. The ink-jet head according to claim 1, further comprising an ink outlet channel linking the ink outlet opening and the ink discharge channel together, wherein the ink outlet channel has a bend.

4. An ink-jet apparatus comprising the ink-jet head according to claim 1.

5. An ink-jet apparatus comprising the ink-jet head according to claim 2.

6. An ink-jet apparatus comprising the ink-jet head according to claim 3.

* * * * *